US006186880B1

(12) United States Patent
Gonzalez et al.

(10) Patent No.: US 6,186,880 B1
(45) Date of Patent: Feb. 13, 2001

(54) RECYCLABLE RETAINING RING ASSEMBLY FOR A CHEMICAL MECHANICAL POLISHING APPARATUS

(75) Inventors: Jose Gonzalez, Redwood City; Dave Jordan; Andrew Tudhope, both of Alamo, all of CA (US)

(73) Assignee: Semiconductor Equipment Technology, Dublin, CA (US)

( * ) Notice: Under 35 U.S.C. 154(b), the term of this patent shall be extended for 0 days.

(21) Appl. No.: 09/408,014

(22) Filed: Sep. 29, 1999

(51) Int. Cl.[7] ..... B24B 47/02

(52) U.S. Cl. ..... 451/397; 451/398; 451/285; 451/287; 451/288

(58) Field of Search ..... 451/397, 398, 451/285, 287, 288

(56) References Cited

U.S. PATENT DOCUMENTS 6,080,040 * 6/2000 Appel et al. ..... 451/10
6,080,046 * 6/2000 Shendon et al. ..... 451/54

* cited by examiner

*Primary Examiner*—David A. Scherbel
*Assistant Examiner*—Shantese McDonald
(74) *Attorney, Agent, or Firm*—Gray Cary Ware & Freidenrich

(57) ABSTRACT

An annular ring assembly is provided in which mechanical elements of the retaining ring assembly maintain strict planar flatness, rigidity, high tolerances and surface stability control. Additionally, glues, adhesives, and epoxies are eliminated from the construction of the plastic retaining and backing ring assembly. Further, adverse chemical reaction and contamination from adhesives that are typically in direct contact with chemical slurry and substrate layers undergoing polishing are eliminated. As a result, the present invention provides a low cost alternative to suppliers and manufacturers of retaining rings and facilitates a method to exchange, recondition and recycle the retaining ring for an infinite period, thus reducing consumable waste materials. Further, the ring assembly maintains uniform mechanical properties and strict tolerances after post reconditioning, thus reducing the variability and maintaining process consistency.

17 Claims, 17 Drawing Sheets

RECYCLABLE RETAINING RING ASSEMBLY FOR A CHEMICAL MECHANICAL POLISHING APPARATUS

BACKGROUND OF THE INVENTION

The present invention relates generally to chemical mechanical polishing of substrates, and more particularly to a recyclable retaining ring used on a carrier head in a chemical mechanical polishing system.

Many different manufacturing operations use chemical mechanical polishing; one such operation is the manufacturing of integrated circuits. Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly more non-planar. This occurs because the distance between the outer surface and the underlying substrate is greatest in regions of the substrate where the least etching has occurred, and the distance is least in regions where the greatest etching has occurred. With a single patterned underlying layer, this non-planar surface comprises a series of peaks and valleys where the distance between the highest peak and the lowest valley may be on the order of 5,000 to 12,000 Angstroms. With multiple patterned underlying layers, the height difference between the peaks and the valleys becomes even more severe and can reach several microns.

This non-planar outer surface presents a problem for integrated circuit manufacturers. If the outer surface is non-planar, then photolithographic techniques to pattern photoresist layers might not be suitable, as a non-planar surface can prevent proper focusing of the photolithography apparatus. Therefore, there is a need to periodically planarize this substrate surface. Planarization, in effect, polishes away peaks and valleys of non-planar outer surface layers of the integrated circuit, whether conductive, semiconductive, or insulative layers, to form a relatively flat smooth surface. Following planarization, additional layers may be deposited on the outer layer to form interconnect lines between features, or the outer layer may be etched to form vias to lower features.

Chemical mechanical polishing, commonly referred to as CMP, is a method of planarizing or polishing substrates. In a typical CMP process, a rotating polishing pad, which receives a chemically reactive slurry is used to polish the outermost surface and layers of the substrate. The substrate is positioned over the polishing pad, which is typically mounted in a carrier and retaining ring assembly. The carrier and retaining ring assembly maintains a bias force between the surface of the substrate and the rotating polishing pad. The movement of the slurry-whetted polishing pad across the surface face of the substrate causes material to be chemically and mechanically polished (removed) from that face of the substrate.

Different types of pads and slurry mixtures may be used. Each polishing pad provides a polishing surface which, in combination with the particular slurry mixture, can provide specific polishing characteristics. Thus, for any material being polished, the pad and slurry combination is selected to provide a desired finish and flatness on the polished surface. The pad and slurry combination can provide this finish and flatness in a predetermined polishing time. Additional factors, such as the relative speed between the substrate and the pad, and the force pressing the substrate against the pad affect the polishing rate finish and flatness.

One problem with conventional CMP processing is the high volume of wearable parts which are consumed as the substrates are polished. Generally, a retaining ring assembly is mounted under a substrate carrier that continually wears down as the polishing pad makes direct contact against featured substrate layer surfaces. Consequently, the retaining ring assembly burdens a significant cost as a consumable item for general CMP systems because the entire assembly needs to be discarded and replaced. Moreover, the retaining ring assembly should be able to stay substantially parallel to the polishing pad after repeated recycling and replacement. The parallel relationship between the polishing pad and the retaining ring assembly is desirable to eliminate any angular deformities that could result in substandard CMP polishing.

There is a need to for an apparatus and method, which overcomes the foregoing and other problems and which substantially reduces the cost of the retaining ring assembly in a CMP apparatus. It is to these ends that the present invention is directed.

SUMMARY OF THE INVENTION

The invention advantageously provides an apparatus and method to reduce consumable operating expenses in CMP processes by utilizing low cost recyclable components without risking or compromising process performance, material stability, and loss of yield.

The invention provides an annular ring assembly is provided in which mechanical elements of the retaining ring assembly maintain flatness, rigidity, high tolerances and surface stability control. Additionally, glues, adhesives, and epoxies are eliminated from the construction of the plastic retaining and backing ring assembly. Further, adverse chemical reaction and contamination from adhesives that are typically in direct contact with chemical slurry and substrate layers undergoing polishing are eliminated.

As a result, the present invention provides a low cost alternative to suppliers and manufacturers of retaining rings and facilitates a method to exchange, recondition and recycle the retaining ring for an infinite period, thus reducing consumable waste materials. Further, the ring assembly maintains uniform mechanical properties and strict tolerances after post reconditioning, thus reducing the variability and maintaining process consistency.

In one aspect the invention provides an annular ring assembly for a chemical mechanical polishing apparatus comprising an annular backing ring having a recessed channel reference guide groove portion arranged circumferentially within the inner surface of the backing ring and an annular retaining ring having an associated raised neck portion extending circumferentially from the inner surface of the retaining ring, wherein the respective groove and neck portions communicate to secure the backing ring and the retaining ring. Thus, the annular retaining ring may be secured with, and is removable from, the channel reference guiding groove. When the annular retaining ring becomes worn from repetitive use of the assembly, the retaining ring may be removed from the backing ring and replaced with a new annular retaining ring. As a result, the discarding of the entire assembly and the waste of high precision material can be avoided.

DETAILED DESCRIPTION OF THE PREFERRED EMBODIMENT

Figure 1A:
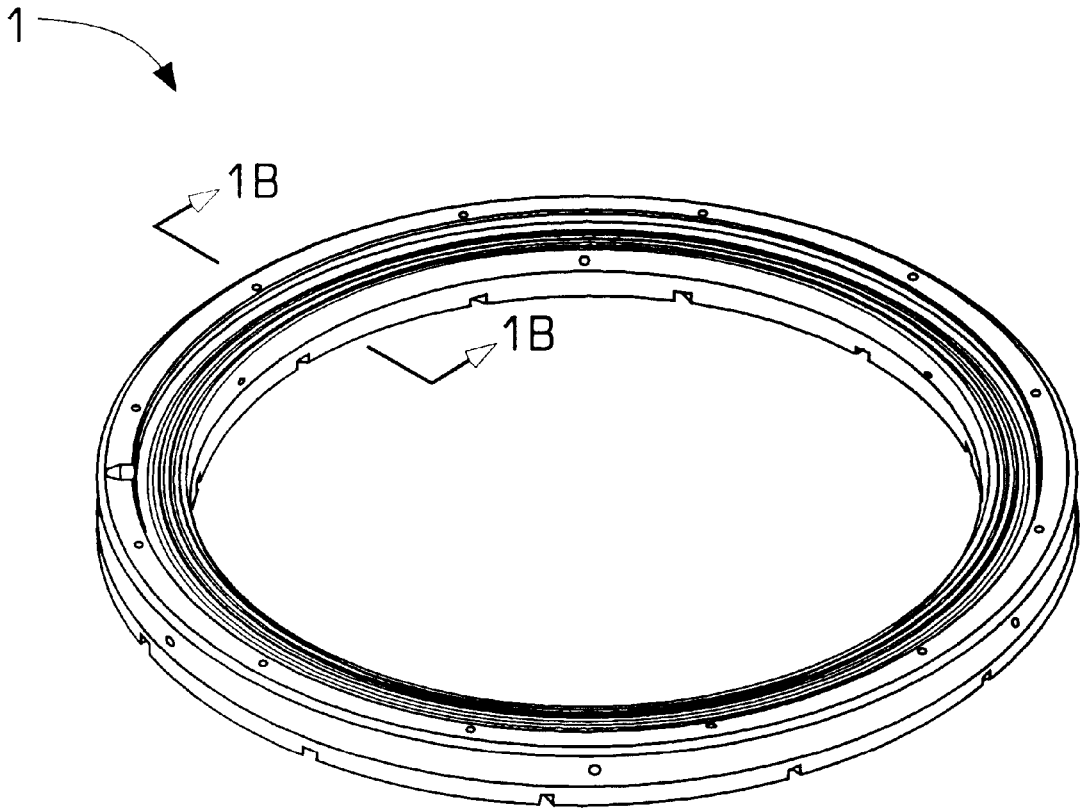
FIGURE 1A PRIOR ART
FIG. 1*a* is an isometric view of a conventional CMP retaining ring assembly using an adhesive mechanical bonding to unite a backing ring and a retaining ring of the assembly.
Figure 1B:
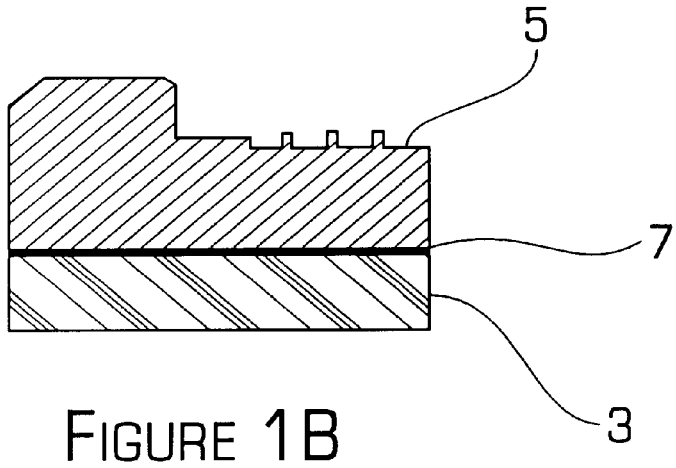
FIG. 1*b* is a cross-sectional view of the conventional CMP retaining ring assembly shown in FIG. 1*a;*

A conventional retaining ring assembly 1 is shown in FIG. 1*a*. FIG. 1*b* is a cross-sectional view of the retaining ring assembly 1. The two-piece ring assembly 1 typically comprises a plastic retaining ring 3 attached to an annular stainless steel backing ring 5. After several hundreds of repeated CMP cycles, the plastic interface of the retaining ring assembly wears down proportional to the number of processed substrates under the carrier head. The entire retaining ring assembly 1 (plastic and annular stainless steel rings) must be discarded and replaced on a frequent interval. The disadvantage of the current retaining ring method is the associated cost of the stainless steel backing ring 5 component in relation to discarding the entire assembly 1.

The major cost associated with the conventional two-piece retaining ring assembly 1 is the backing ring 5. The stainless steel backing ring 5 is typically highly ground-precision stainless steel with tight tolerances and precisely patterned mounting holes. The backing ring 5 (including the attached plastic ring 3) is the direct interface between the carrier head (not shown) of the CMP platform and polishing pad (not shown). Besides mounting the carrier, the backing ring 5 provides stiffness and backing to the plastic-retaining ring 3. The current design of the plastic retaining ring 3 is fastened to the stainless steel backing ring 5 by a permanent adhesive compound 7. Consequently, the entire assembly 1 must be discarded after subsequent usage. This limitation is costly and results in waste of high precision material.

Figure 2:
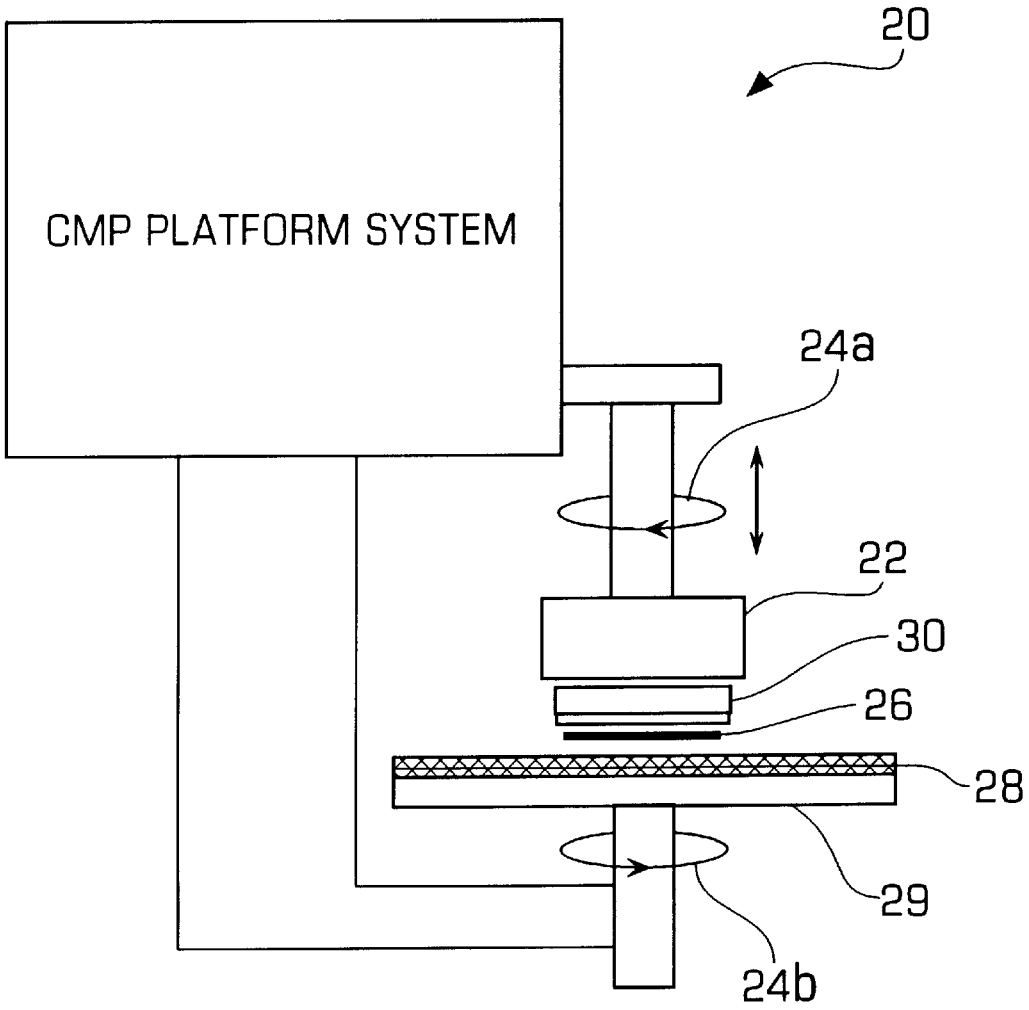
FIG. 2 is a block representation of a chemical mechanical polishing system, including the carrier head, retaining ring, substrate and polishing pad, with which the invention may be used.

FIG. 2 shows a chemical mechanical polishing system 20 having a carrier head assembly 22 rotatably mounted to the system 20 via a rotatable axle 24*a*. An annular retaining ring assembly 30 is typically secured to the carrier head assembly 22, as by means of an opposing threaded engagement interface, which will be described in detail later with respect to a preferred embodiment of the retaining ring assembly 30. A substrate 26 sits within the retaining ring assembly 30 and is held within the retaining ring assembly 30 and is brought into physical contact with a polishing pad 28 via a U-shaped bladder (not shown) that is disposed within the retaining ring assembly and abuts against an opposing surface of the substrate 26. The pad 28 operates to polish the substrate 26 which may be supported by a rotatable polishing platen 29. The rotatable polishing platen 29 may be fixed to the system 20 via a second rotatable axle 24*b*. Axles 24*a* and 24*b* are preferably independent of each other, and preferably rotate in opposing directions (i.e., clockwise and counter-clockwise). In this manner, polishing can be effected in a relatively efficient manner, as the opposing rotational forces operate to maintain frictional contact between the polishing pad 28 and the substrate 26 which is needed to effectively polish the substrate 26.

Figure 3:
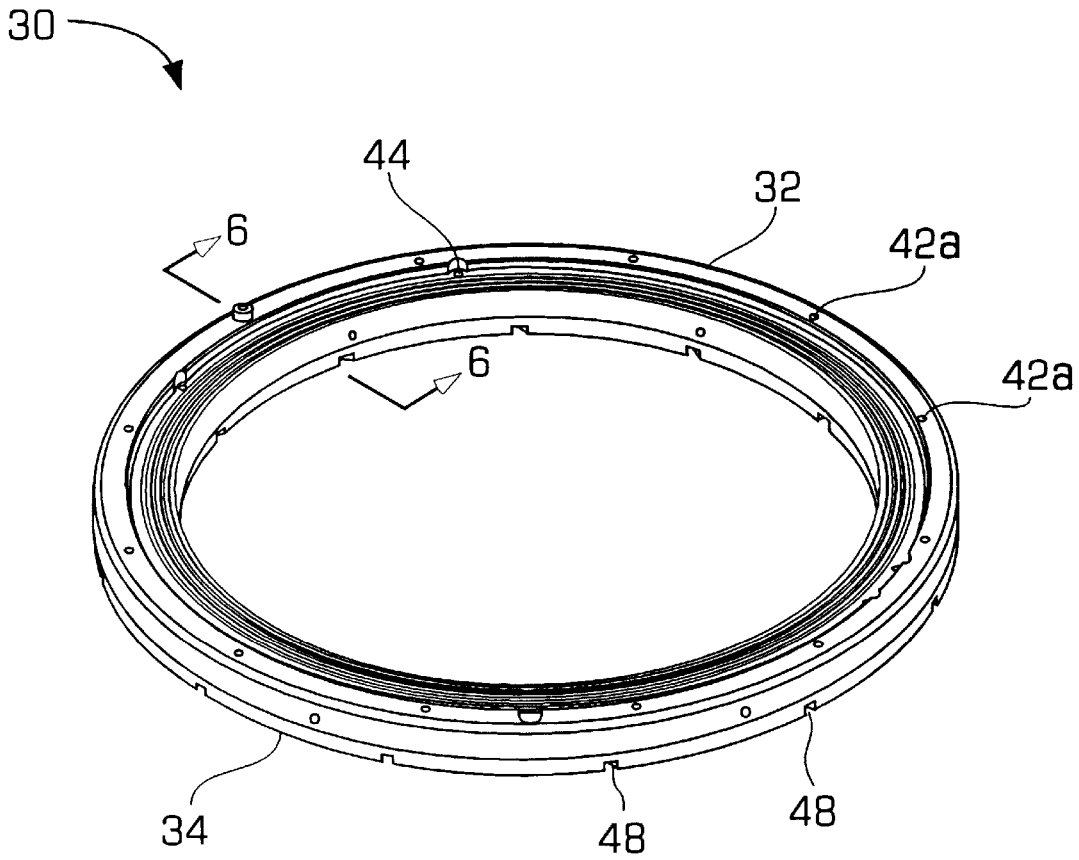
FIG. 3 is an isometric view of a first embodiment of a CMP retaining ring assembly apparatus according to the invention.
Figure 4A:
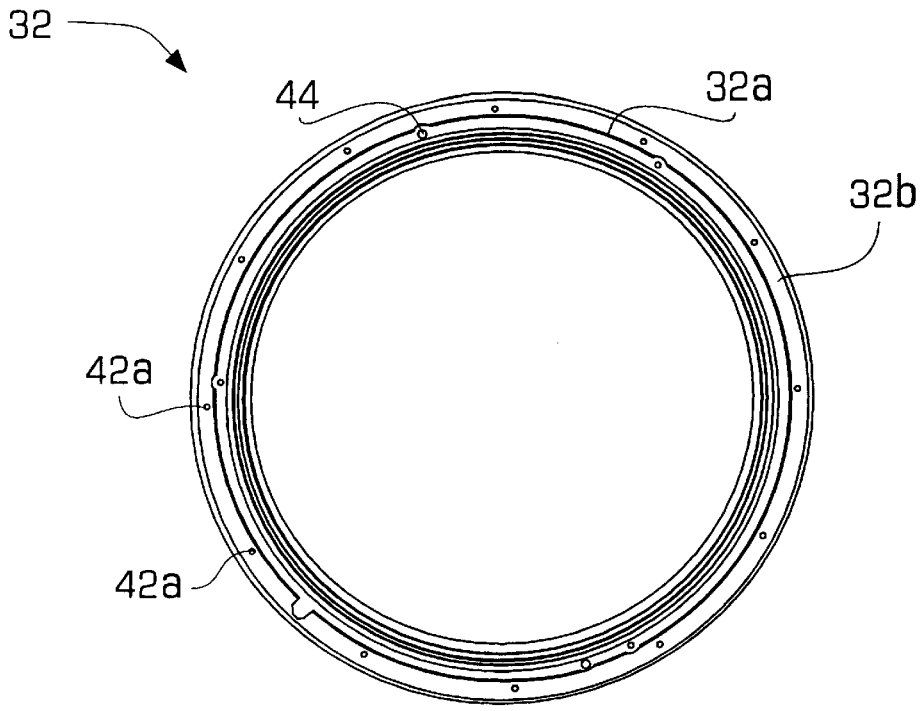
FIG. 4*a* is a bottom view of an annular backing ring portion of the ring assembly apparatus shown in FIG. 3.
Figure 4B:
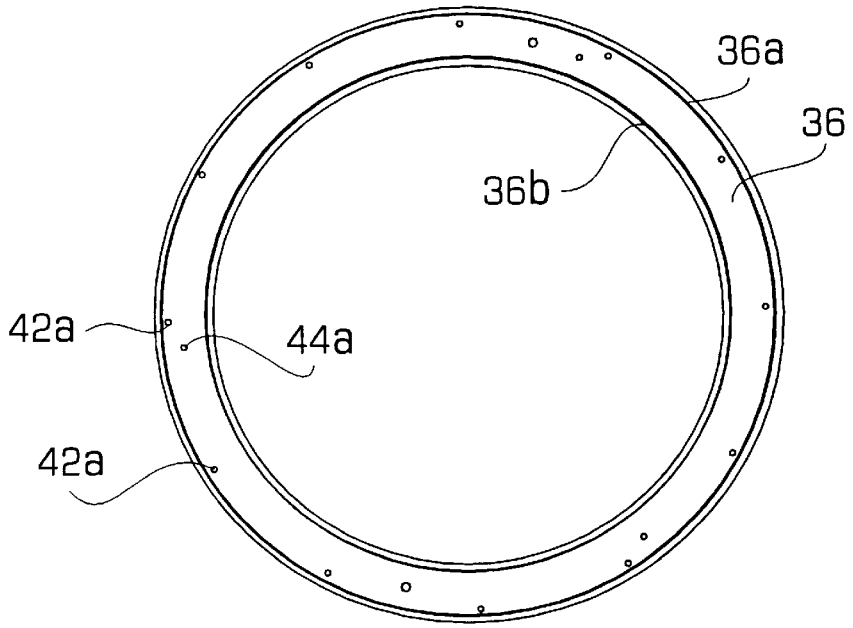
FIG. 4*b* is a top view of the annular backing ring portion of the ring assembly apparatus shown in FIG. 4*a;*

FIGS. 3, 4*a* and 4*b* show an isometric view of a first embodiment of a chemical mechanical polishing retaining ring assembly 30 according to the invention. The ring assembly 30 may comprise an annular backing ring 32 and an annular retaining ring 34. The annular backing ring 32 may have a recessed channel or groove 36 arranged circumferentially along the inner surface 32*a* of the backing ring 32. The respective edges 36*a*, 36*b* of the channel or groove 36 may be outwardly tapered at a slight angle so as to form a beveled edge. This beveled edge is similar to a "dovetail" configuration that is a typical forming and aligning technique in which the edges of a groove are tapered so as to be capable of securing and aligning an opposing member inserted within the groove. Preferably, the angle of taper is slight, such as 1°, but the angle of taper could be as large as 5° or more. This relationship can be appreciated with reference to FIGS. 6–7, which show the dovetail locking feature of the invention.

Figure 5A:
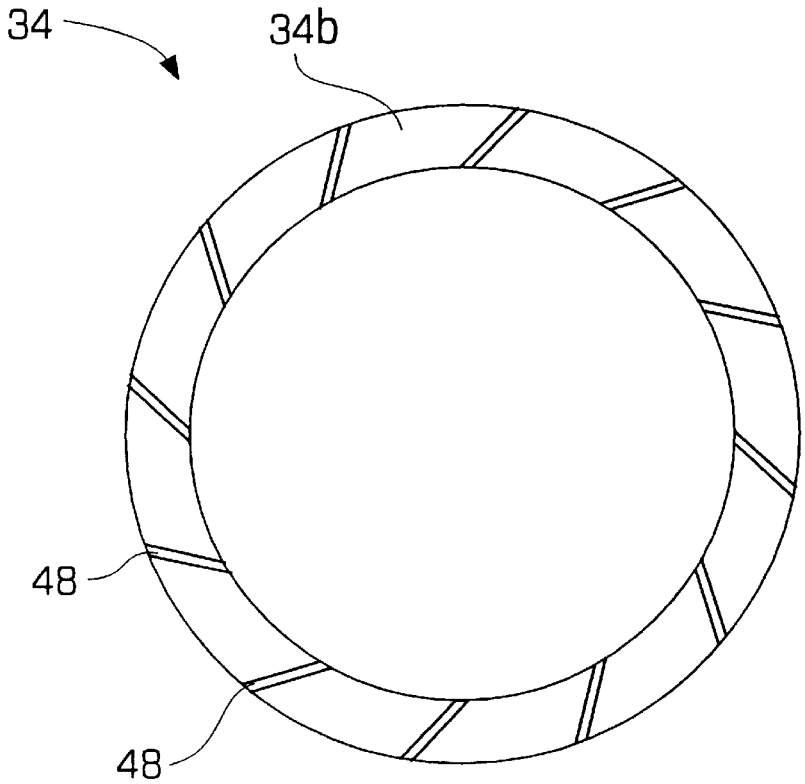
FIG. 5*a* is a top view of an annular retaining ring portion assembly apparatus shown in FIG. 3.
Figure 5B:
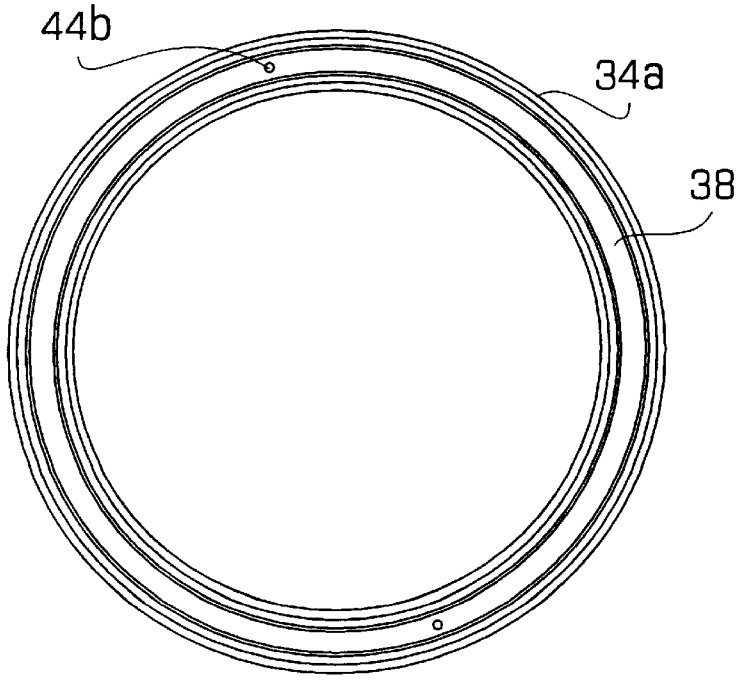
FIG. 5*b* is a bottom view of the annular retaining ring portion of the ring assembly apparatus shown in FIG. 5*a;*

The annular retaining ring 34 may have an associated raised neck 38 protruding circumferentially from along the inner surface 34*a* of the retaining ring 34, as shown in FIGS. 5*a* and 5*a*. This raised neck 38 may be slightly wider than the opposing channel or groove 36 of the backing ring 32 so as to fit snuggly within the narrower channel or groove 36 to prevent sliding motion of the opposing ring portions 32, 34 when the ring assembly 30 is mated. Preferably, the width differential between the raised neck 38 and the channel or groove 36 is about 0.002 meters, however, it is not limited to this dimension and could be wider or narrower. This feature is shown in more detail in FIG. 6, and will be described in detail below.

Additionally, the raised neck 38 may be provided with at least one gap 40 disposed at symmetrical distances from the centerline of the raised neck 38. This gap 40 allows for the raised neck 38 to be compressed during insertion of the raised neck 38 within the channel or groove 36 of the backing ring 32. Upon assembly, the raised neck 38 relaxes to fit snugly within the channel or groove 36. As a result, sliding of the ring assembly components is prevented. Preferably, two gap portions 40 are provided at symmetrical distances relative to the centerline of the raised neck 38, to allow for further compression of the raised neck 38, however, any number of gap portions 40 will suffice. The amount of force required to compress the raised neck 38 to a minimal width necessary to fit the raised neck 38 within the channel or groove 36 is proportional to both the width of the gap 40 and the number of gaps 40 disposed within the raised neck 38.

Figure 6:
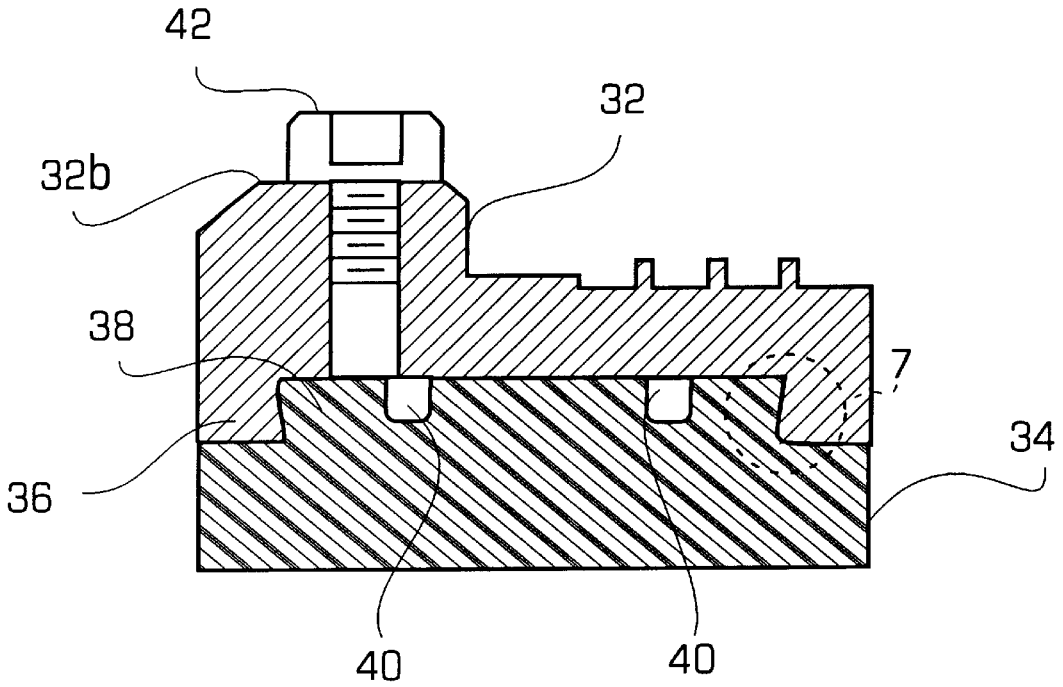
FIG. 6 is a cross-sectional view of the CMP retaining ring assembly of FIG. 3, taken along the line 6—6, showing a dovetail locking feature according to the invention.
Figure 7:
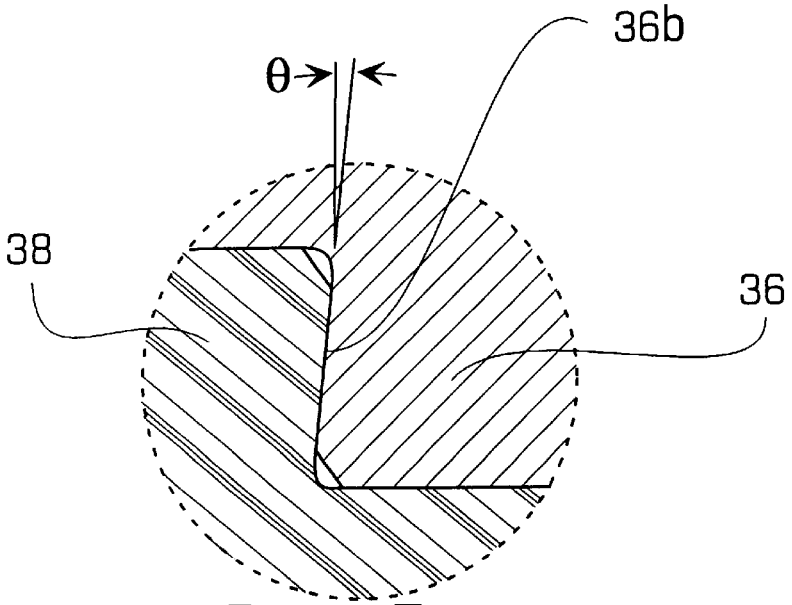
FIG. 7 is an enlarged view of a portion of the cross-sectional view of FIG. 6, taken of the area encompassed by the dotted circle 7.

FIG. 6 shows a cross-sectional view of the annular ring assembly 30 of FIG. 3 taken along the line 6—6. The above-described dovetail feature will now be explained. As can be seen from the enlarged view of the cross-sectional area of the annular ring assembly 30, shown in FIG. 7, adjacent mating edges 36*a*, 36*b* (represented in FIG. 7 as 36*b*) of the channel or groove 36 of the retaining ring 32 are preferably tapered at a slight angle θ so as to form a beveled edge. The raised neck 38 of the annular retaining ring 34 is designed to be slightly wider that the opposing channel or groove 36 of the backing ring 32. The gaps 40 of the raised neck portion 38 allow for compression of the neck portion 38 upon mating of the retaining ring 32 and backing ring 34, so as to secure the retaining ring 32 to the backing ring 34 and prevent slidable motion of the ring assembly 30 when mated.

Referring again to FIGS. 3–6, additionally, the backing ring 32 may have a pin 42 that operates to separate the backing ring 32 from the retaining ring 34, when it is desired to replace the plastic retaining ring 34 which may have become worn due to the chemicals and friction involved in the CMP process. By causing a translational force to be applied to the backing ring 34, via the removal pin 42, the separation of the ring assembly 30 can be forced. Typically, the removal pin 42 is a screw, but could be any such pressure exerting means.

Figure 8:
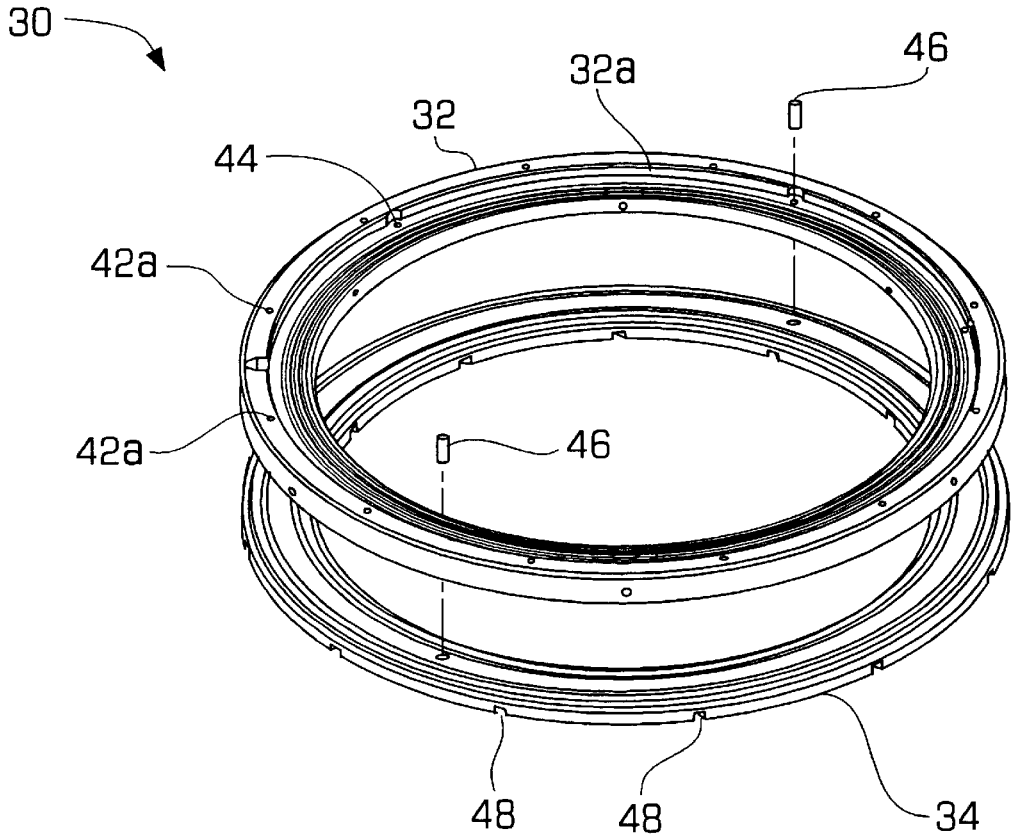
FIG. 8 is an exploded view of the CMP retaining ring assembly apparatus shown in FIG. 3.

Additionally, dowel pin cavities 44 may be provided at respective intervals along the inner diameter surface 32*a* of the backing ring 32. These dowel pin cavities 44 are associated with respective dowel pin insertion holes 44*a* along the inner surface 32*a* of the backing ring 32. When the annular ring assembly 30 is assembled, the dowel pin insertion holes 44*a* are aligned with dowel pin insertion holes 44*b* located along the top surface 34*a* of the retaining ring 34. When the ring assembly 30 is mated, dowel pins 46 can be inserted along dowel pin cavities 44 and through dowel pin insertion holes 44*a*, 44*b*, thereby preventing sliding motion of the ring assembly 30 during operation. For additional security, the annular retaining ring 34 and the backing ring 32 can be fixed together by a mechanical fastener (not shown). The assembly as described above is represented in the exploded view of FIG. 8.

The foregoing structure of the retaining ring assembly 30 eliminates the need for an adhesive bond, as was required by conventional retaining ring assemblies, and, as such, the annular retaining ring 34 can be easily removed from the backing ring 32 without the need for extensive reconditioning, adhesive stripping or surface interface finishing. Therefore, the annular backing ring 32 can be recycled and refurbished and a new retaining ring 34 can be fastened with the recycled annular backing ring 32. As such, the entire ring assembly 30 does not have to be discarded when the annular retaining ring 34 becomes worn and ineffective.

In the carrier ring assembly 30 of the system 20, the plastic retaining ring 34 prevents the shear forces created by the motion of polishing pad 26 from pushing the substrate 26 out from underneath carrier head 22. The retaining ring 34 projects down to the substrate 26 from the outer edge of carrier head 22 to contact the polishing pad 28 and polishing platen 29.

Preferably, the retaining ring 34 is constructed of a plastic composite material, but may also be constructed of other materials. In fact, any rigid, sturdy composition may suffice. The backing ring 32 is preferably constructed of stainless steel, but it may also be constructed of other high tolerance materials, such as titanium or aluminum. Additionally, the bottom surface 34*b* of the annular retaining ring 34 is flat and has a number of slurry channels 48 circumferentially arranged along its surface 34*b*, as shown in FIG. 5*a*. These slurry channels 48 extend from the inner diameter of the ring 34 to the outer diameter of the ring 34 and are disposed at an angle relative to the inner diameter of the ring 34. The slurry channels 48 operate to provide slurry to the polishing pad (not shown) that contacts the substrate (not shown).

Figure 9:
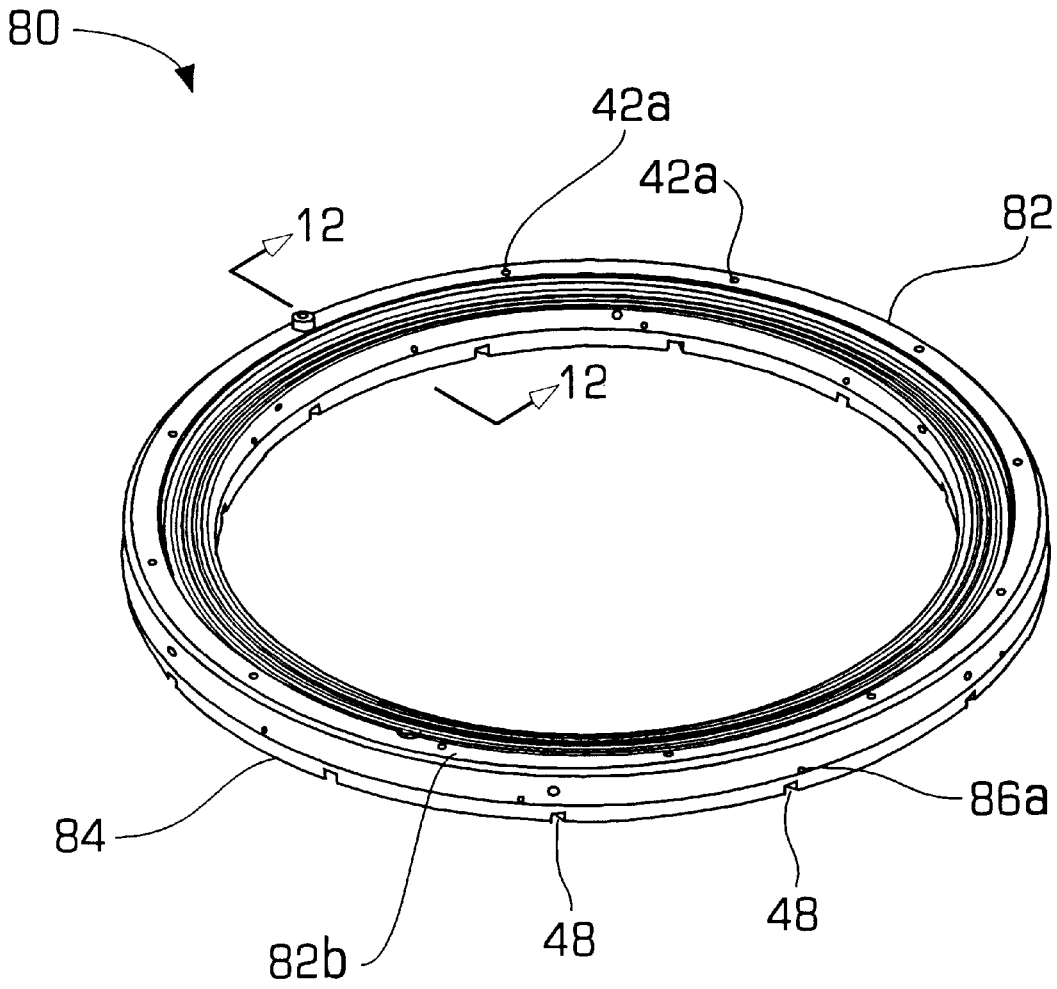
FIG. 9 is an isometric view of a second embodiment of a CMP retaining ring assembly apparatus according to the invention.
Figure 10A:
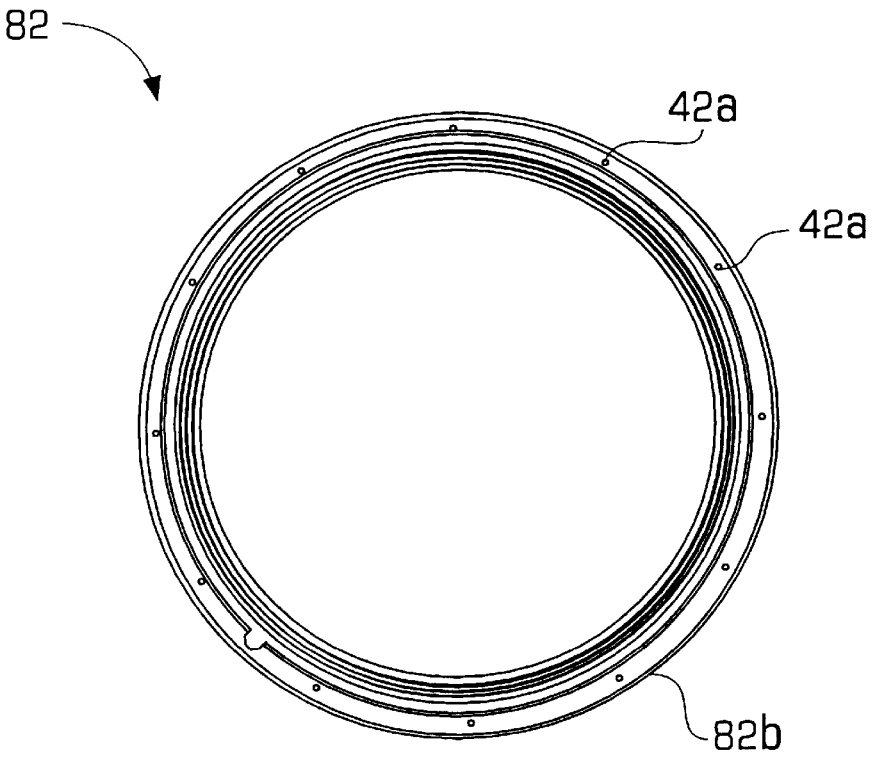
FIG. 10*a* is a top view of an annular backing ring portion of the ring assembly apparatus shown in FIG. 9.
Figure 10B:
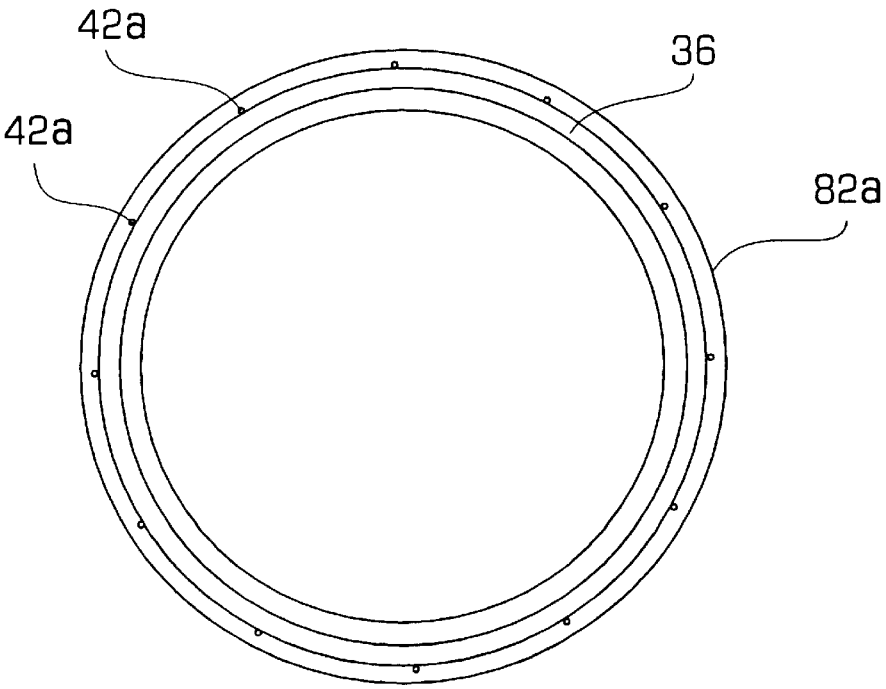
FIG. 10*b* is a bottom view of the annular backing ring portion of the ring assembly apparatus shown in FIG. 10*a;*
Figure 11A:
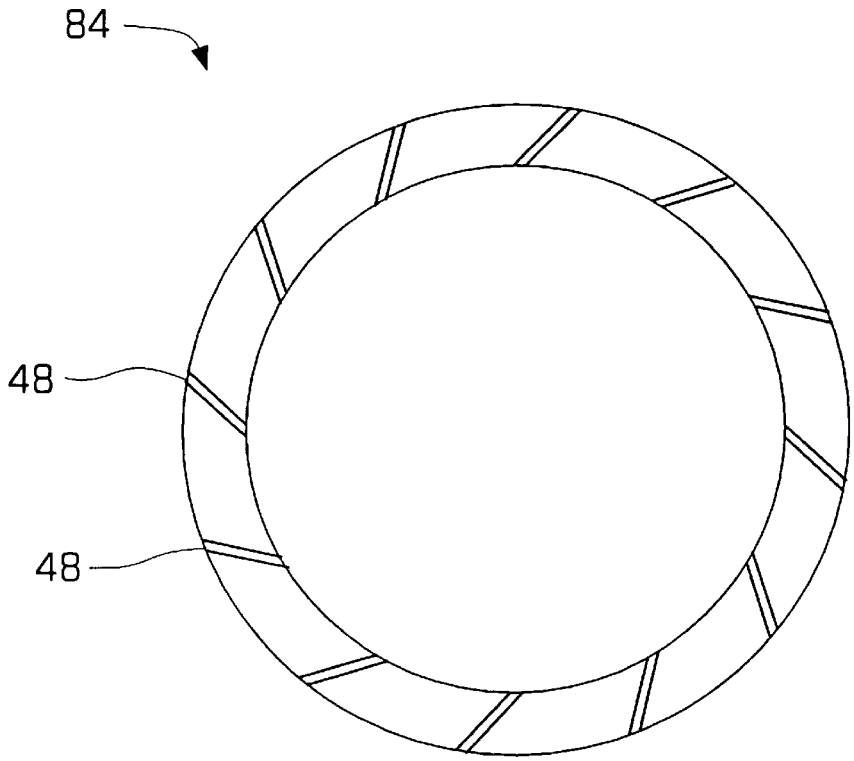
FIG. 11*a* is a top view of an annular retaining ring portion of the ring assembly apparatus shown in FIG. 9.
Figure 11B:
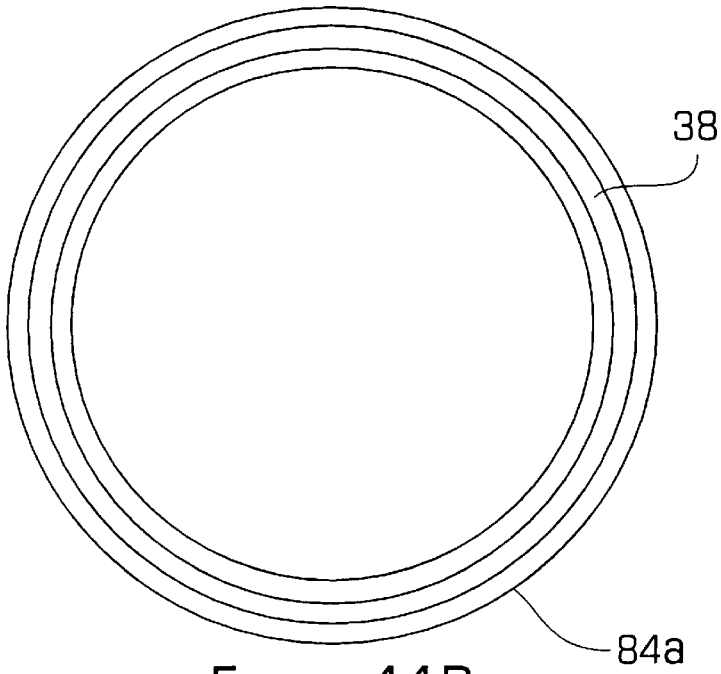
FIG. 11*b* is a bottom view of the annular retaining ring portion of the ring assembly apparatus shown in FIG. 11*a;*
Figure 12:
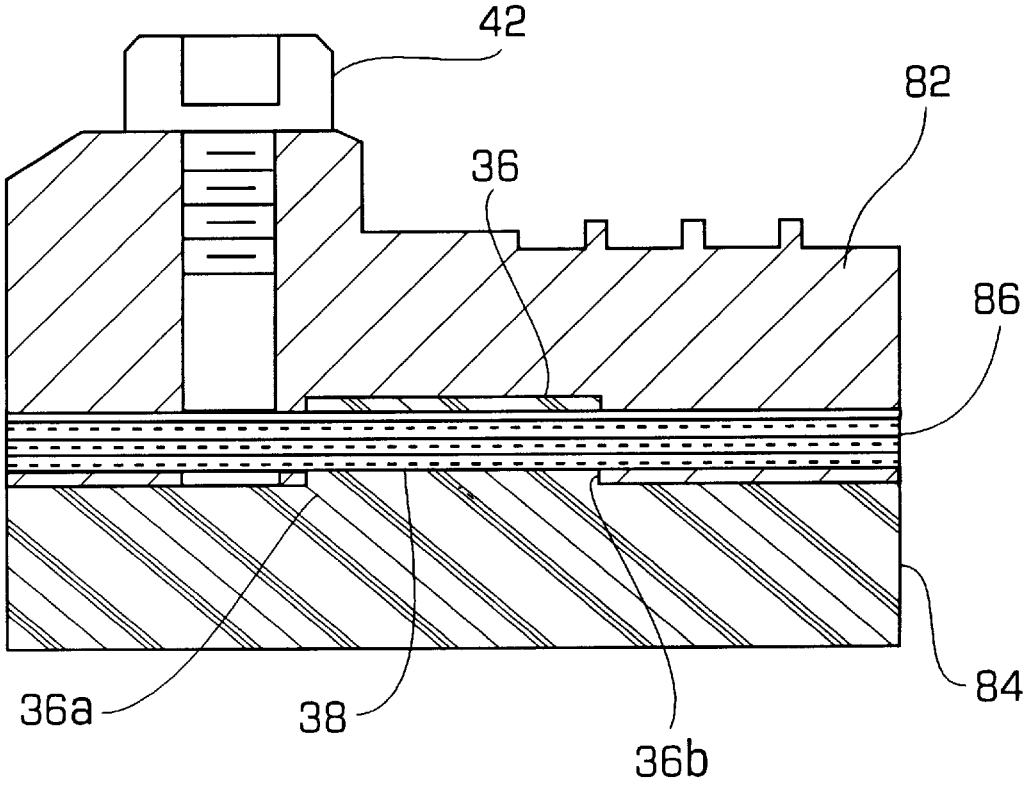
FIG. 12 is a cross-sectional view of the CMP retaining ring assembly of FIG. 9, taken along the line 12—12, showing a locking feature according to a second embodiment of the invention.
Figure 13:
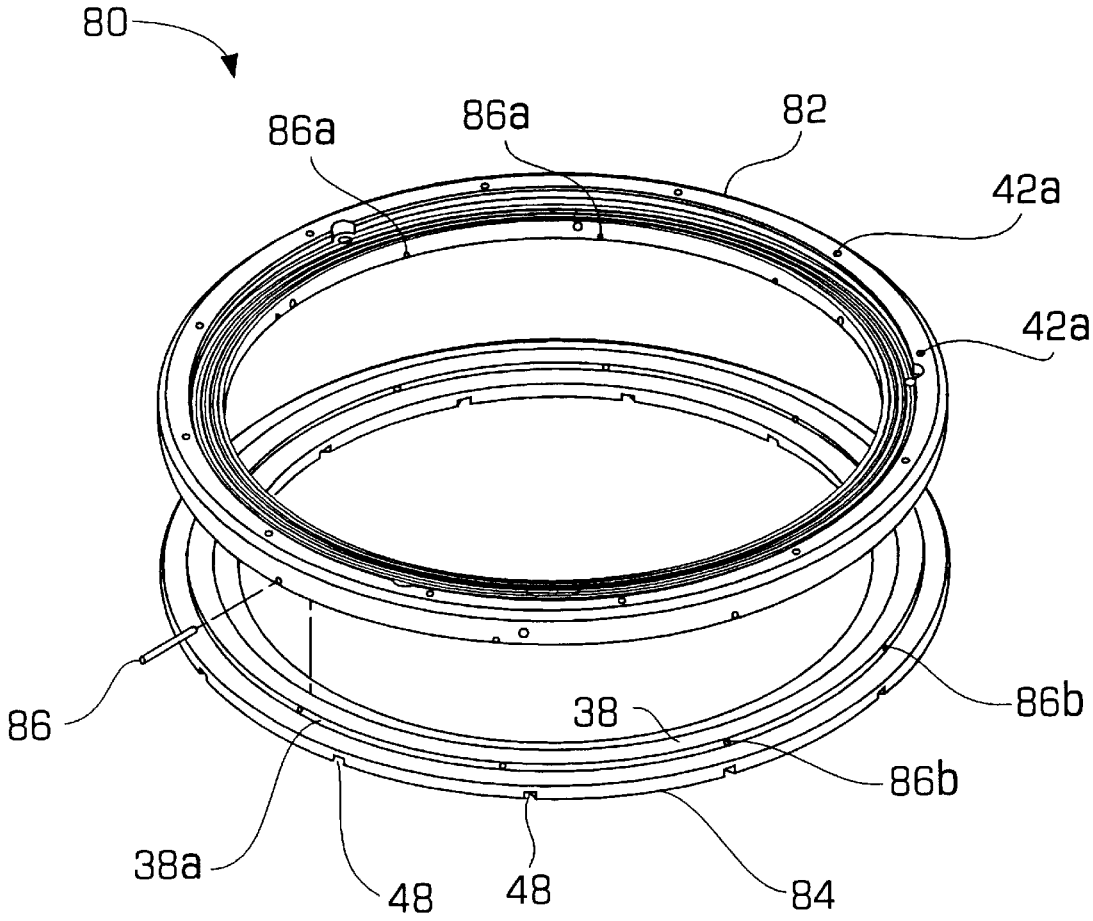
FIG. 13 is an exploded view of the CMP retaining ring assembly apparatus shown in FIG. 9.

FIG. 9 is an isometric view of a second embodiment of the CMP retaining ring assembly 80 according to the invention. In this embodiment, like parts are denoted by like numerals. The ring assembly 80 shown in FIGS. 9–12 is similar to the first embodiment described above. Referring to FIG. 13, the second embodiment differs from the first embodiment in that dowel pin holes 86*a* may be provided at respective intervals along the outer diameter 82*a* of the backing ring 82. These dowel pin holes 86*a* are associated with respective dowel pin insertion holes 86*b* along the outer diameter surface 38*a* of the raised neck 38 of the retaining ring 84. When the annular ring assembly 80 is mated, respective dowel pin insertion holes 86*a* are aligned with respective dowel pin insertion holes 86*b* and locking pins 86 can be inserted through like hole pairs 86*a*, 86*b* and operate to lock the assembly 80 to prevent slidable motion of the components during operation. For additional security, the annular retaining ring 84 and the backing ring 82 can be fixed by a mechanical fastener (not shown).

Subsequently, the retaining ring assembly 80 eliminates the need for an adhesive bond, as was required by conventional retaining ring assemblies, and, as such, the annular retaining ring 84 can be easily removed from the backing ring 82 without the need to consider extensive reconditioning, adhesive stripping or surface interface finishing. Thus, the annular backing ring 82 can be recycled and refurbished and fastened with a new annular retaining ring 84. Therefore, the entire ring assembly 80 does not need be discarded when the annular retaining ring 84 becomes worn and ineffective.

Figure 14A:
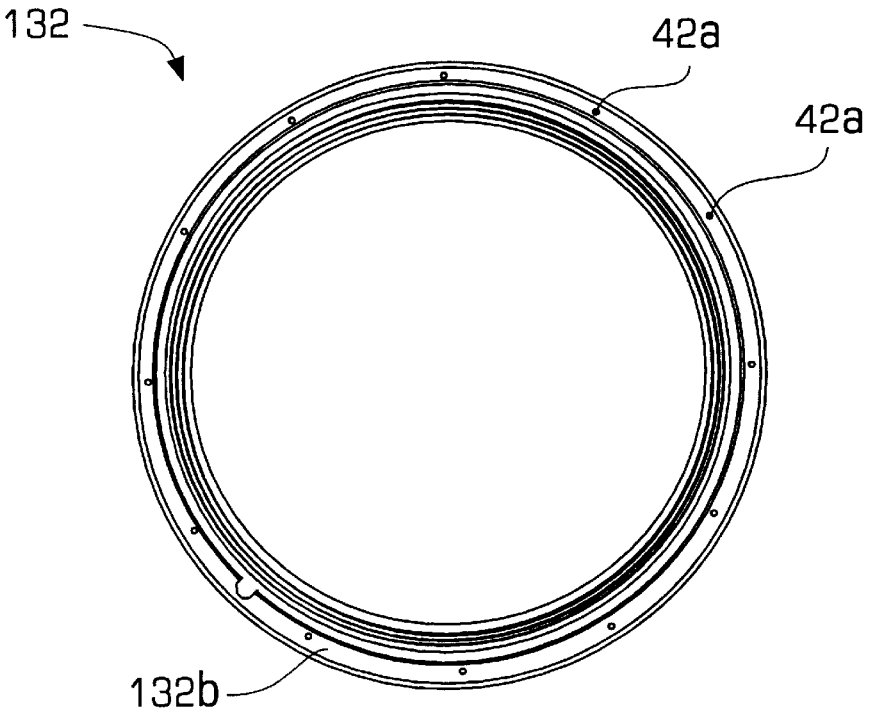
FIG. 14*a* is a top view of a third embodiment of an annular backing ring portion of the ring assembly apparatus of the invention.
Figure 14B:
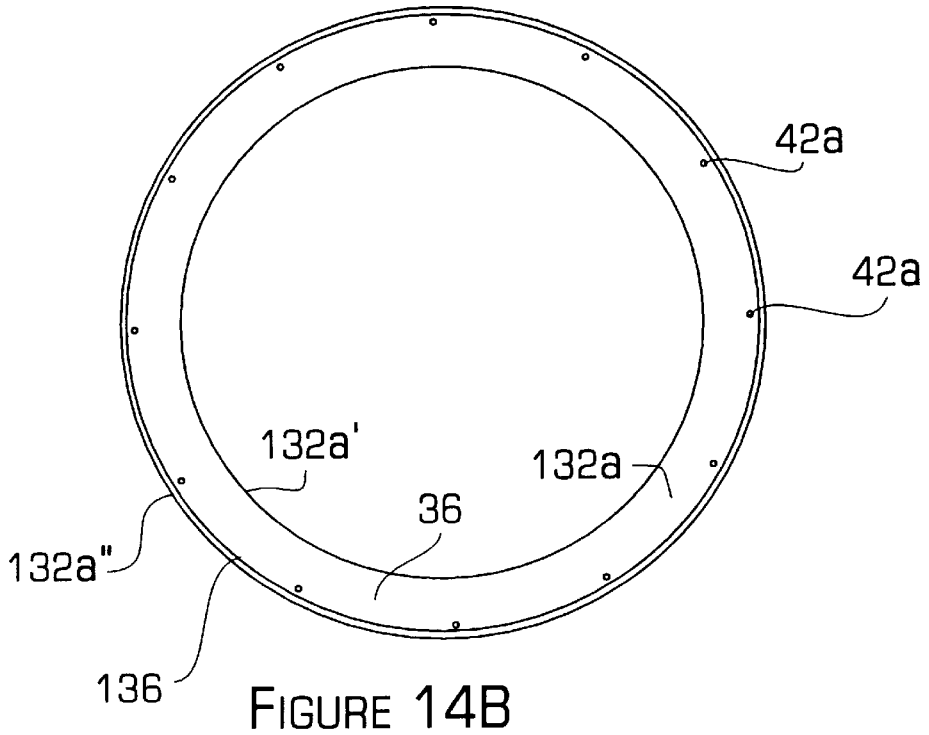
FIG. 14*b* is a bottom view of the annular backing ring portion of the ring assembly apparatus shown in FIG. 14*a;*

Yet another alternative embodiment will now be explained with reference to FIGS. 14A–16. In this embodiment, like features are represented by like numerals. FIGS. 14*a* and 14*b* show respective top and bottom views of a third embodiment of an annular backing ring 132 that makes up a portion of a ring assembly 130. The annular backing ring 132 may have a channel or groove 36 arranged circumferentially along the inner surface 132*a* of the backing ring 132. The groove 36 may extend from the inner diameter 132*a*' of the annular backing ring 132 to a threaded flange edge 136*a* arranged along the outer diameter 132*a*" of the annular backing ring 132. When the annular retaining ring 132 and an annular backing ring 134 are mated, the threaded edge 136*b* of the annular retaining ring 134 and the threaded edge 136*a* of the annular backing ring 132 may be secured via the respective threaded interface relationship. This feature will be explained in detail herein with reference to FIGS. 17 and 18.

Figure 15A:
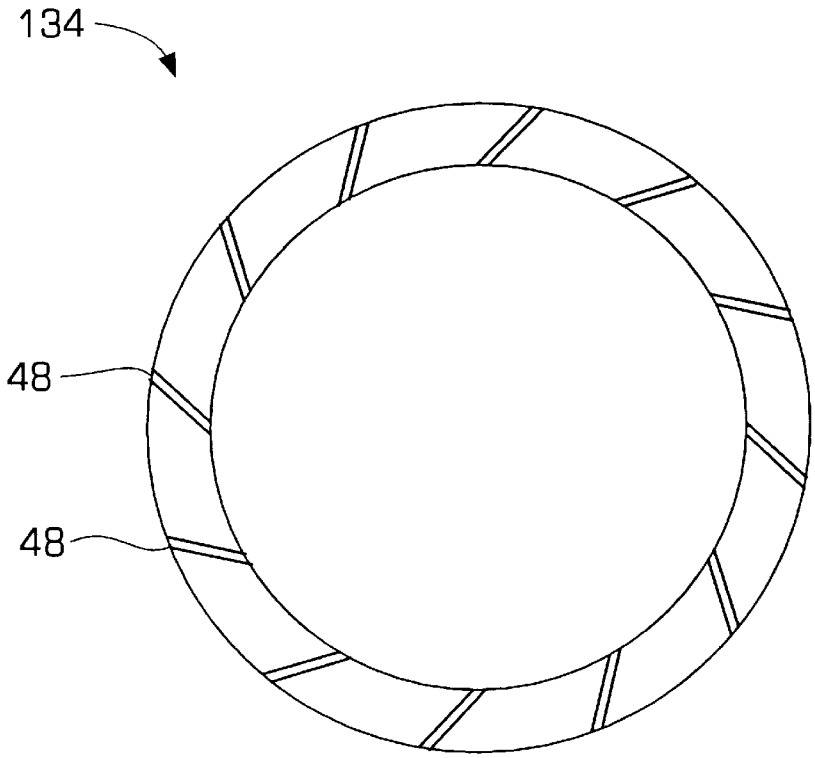
FIG. 15*a* is a top view of a third embodiment of an annular retaining ring portion of the ring assembly apparatus of the invention.
Figure 15B:
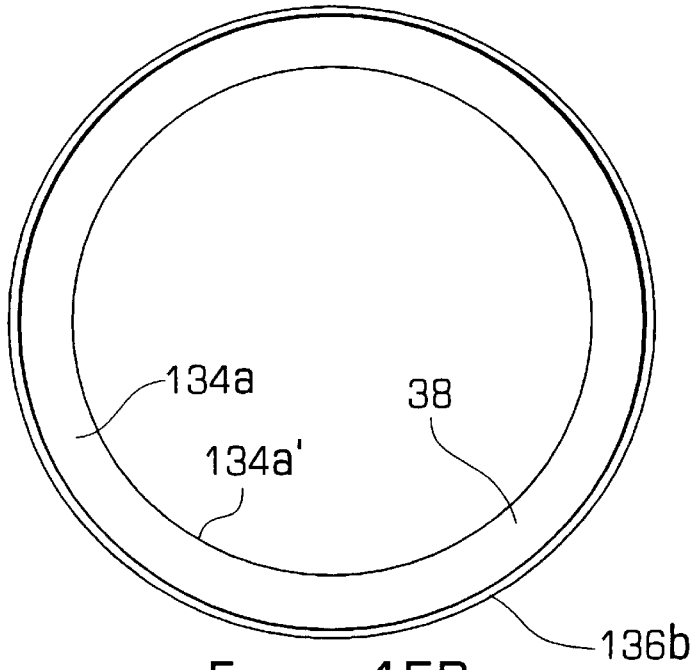
FIG. 15*b* is a bottom view of the annular retaining ring portion of the ring assembly apparatus shown in FIG. 15*a;*

As just explained, an annular retaining ring 134 has an associated raised neck 38 protruding circumferentially from along the inner surface 134*a* of the retaining ring 134, as shown in FIGS. 15*a* and 15*b*, respectively. The raised neck 38 may extend from the inner diameter 134*a*' of the annular retaining ring 134 to a distance slightly narrower in width than the length of the inner surface 134*a* of the retaining ring 134. The outer edge 136*b* of the raised neck portion 38 may be a threaded edge 136*b*. When the assembly 130 is mated, the opposing threaded edges interface to secure the retaining ring 134 to the backing ring 132. Therefore, no additional locking pins (not shown) are required.

Figure 16:
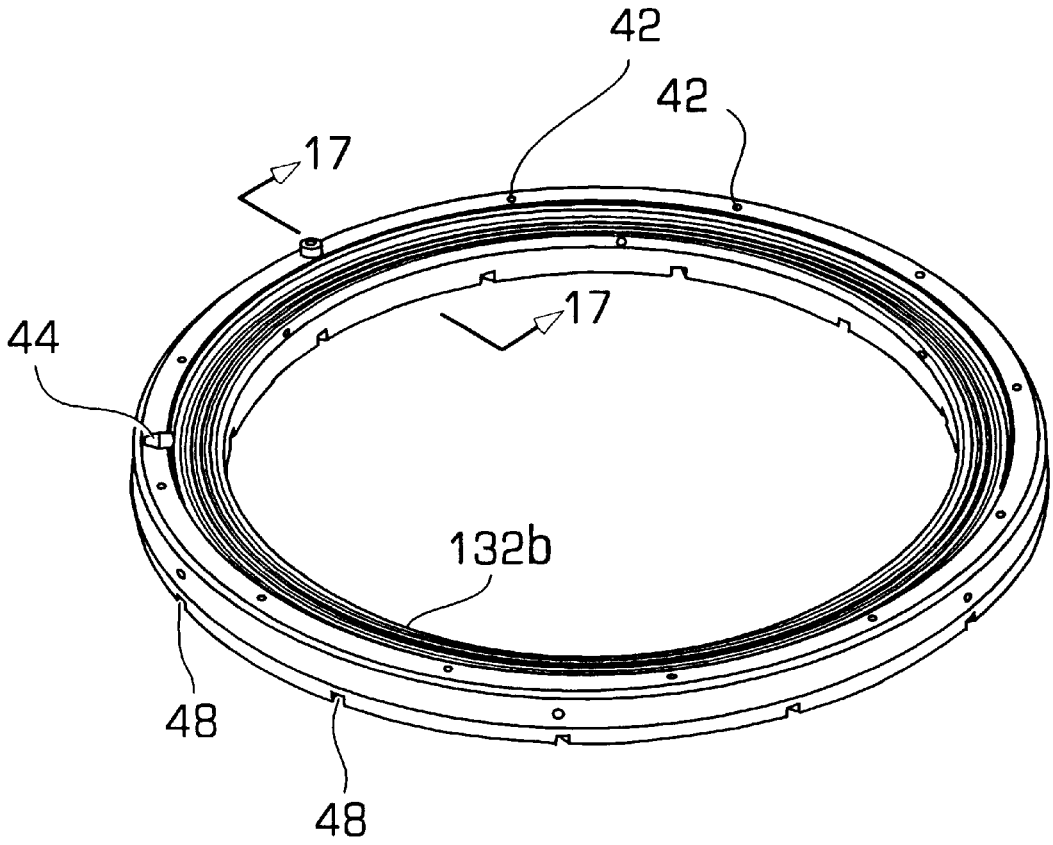
FIG. 16 is an isometric view of another embodiment of the annular ring assembly according to the invention.
Figure 17:
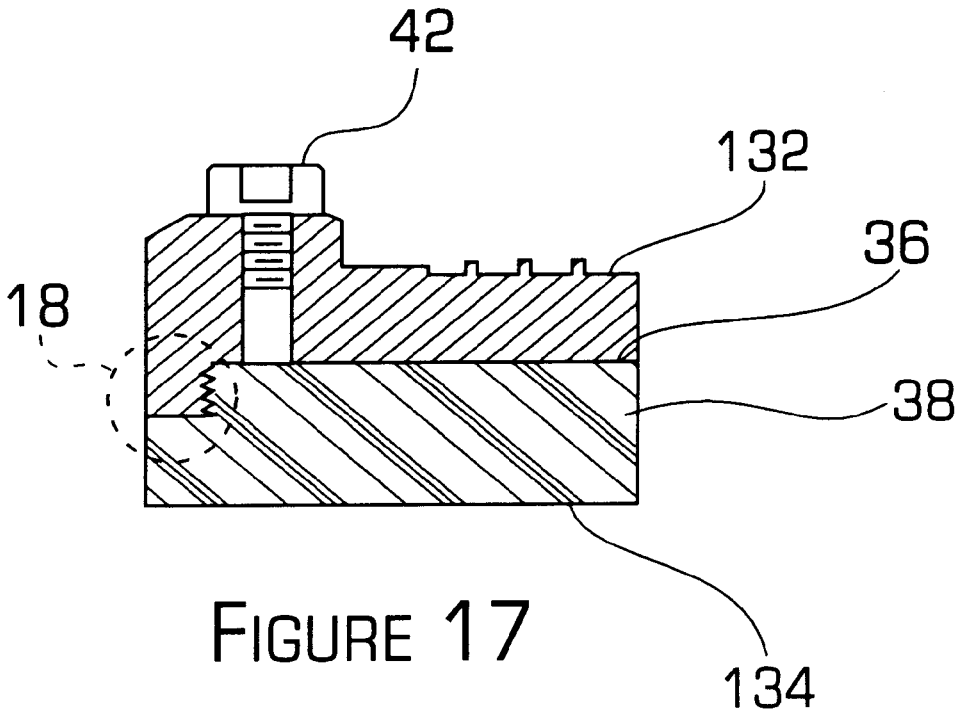
FIG. 17 is a cross-sectional view of the CMP annular retaining ring assembly, taken along the line 17—17, showing a screw thread locking feature of the invention.
Figure 18:
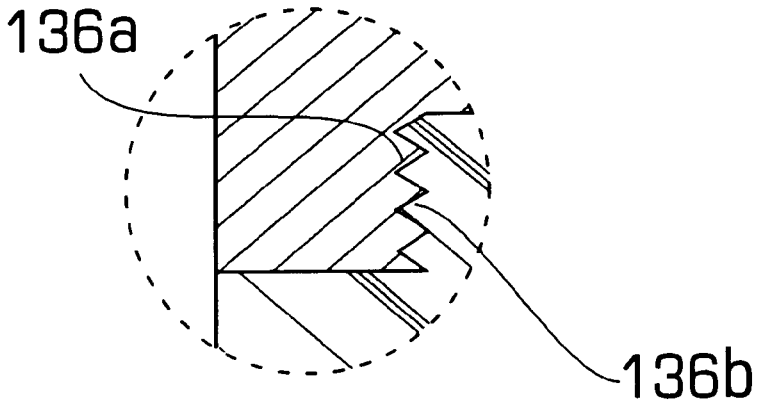
FIG. 18 is an enlarged view of a portion of the cross-sectional view of FIG. 17, taken of the area encompassed by the dotted circle 18.
Figure 19:
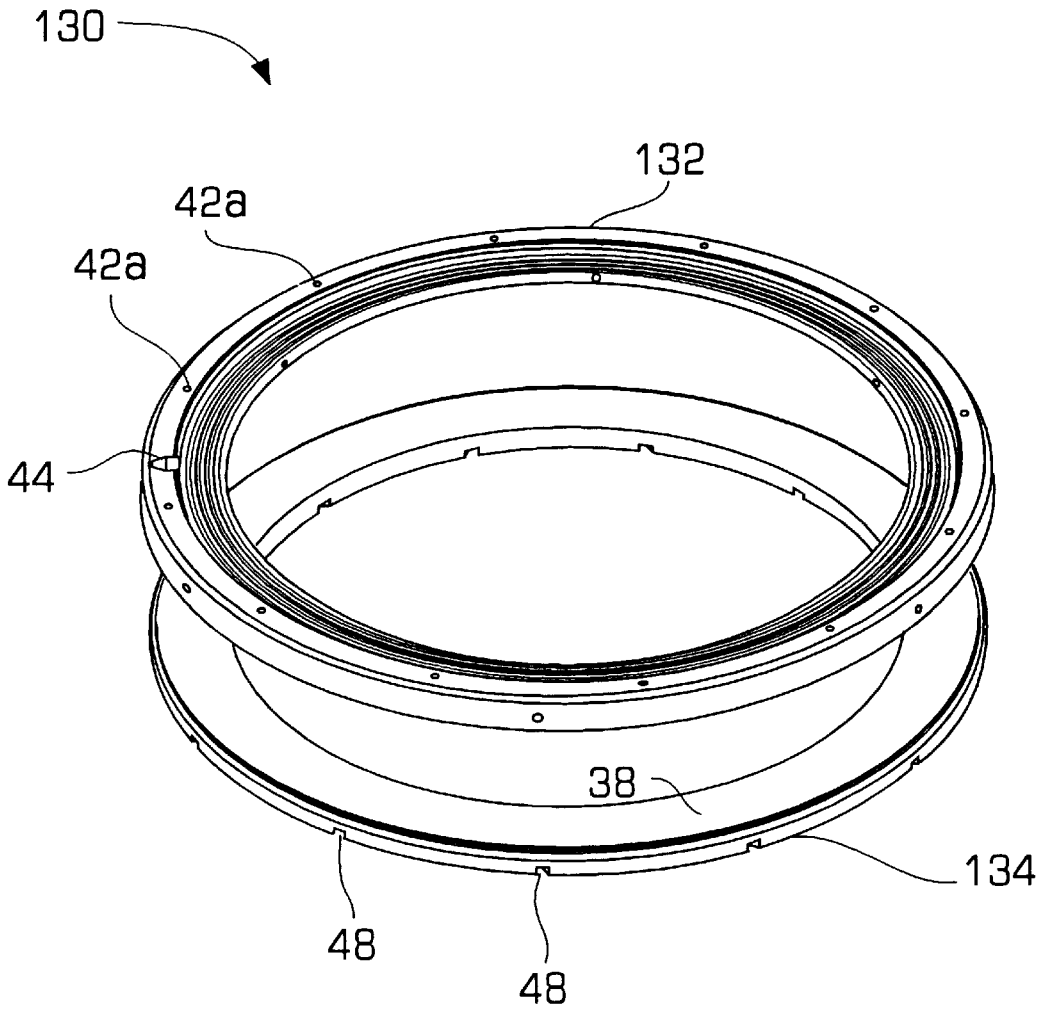
FIG. 19 is an exploded view of the CMP retaining ring assembly shown in FIG. 16.

Referring now to FIGS. 16–18, a cross-sectional view of the annular ring assembly 130 is shown taken along the line 17—17. When mated, the raised neck 38 of the annular retaining ring 134 together with the threaded edge 136*b* is designed to be slidably connected with the channel or groove 36 of the backing ring 132 and its respective threaded flange edge 136*a*. The ring assembly 130 is locked and held in place via this threaded relationship, as can be seen in the enlarged view of the connection interface in FIG. 18. Thus, slidable motion between the components of the assembly 130 is prevented. An exploded view of the assembly 130 is shown in FIG. 19.

The design of the invention maintains the necessary characteristics of structural rigidity, flatness and parallelism equivalent to conventional CMP two-piece retaining ring assembly products available in the market. However, unlike conventional assemblies, the backing ring and retaining ring can be recycled with minimum reconditioning costs and expenses.

While the foregoing has been described with reference to particular embodiments of the invention, it will be appreciated by those skilled in the art that changes in these embodiments may be made without departing from the principles and spirit of the invention, the scope of which is defined by the appended claims.

What is claimed is:

1. An annular ring assembly for a chemical mechanical polishing apparatus, comprising:

an annular retaining ring that is individually securely affixable to an annular backing ring, the annular retaining ring and the annular backing ring being releasably connectable such that the annular backing ring is reusable with another annular retaining ring.

2. The assembly of claim 1, wherein said annular backing ring is of metal and wherein said annular retaining ring is of a resilient material.

3. The assembly of claim 2, wherein said annular retaining ring is plastic.

4. The assembly of claim 1, wherein said retaining ring and said backing ring are dimensioned to be snap-fitted together.

5. An annular ring assembly for a chemical mechanical polishing apparatus, comprising:

an annular retaining ring that is releasably connectable to an annular backing ring such that the annular backing ring is reusable with another annular retaining ring, wherein the annular backing ring has a circumferentially extending channel, and the annular retaining ring has a raised circumferentially extending neck, the raised neck being dimensioned to be insertably connected within the channel to releasably secure the backing ring and the retaining ring in a mated relationship.

6. The assembly of claim 5, wherein at least one gap is disposed within said raised neck such that said raised neck can be compressed from a first width to a second width by application of a compression force to said raised neck to enable said raised neck to be insertably connected with said channel when said raised neck is compressed to said second width, wherein said raised neck engages said channel upon relaxation of said raised neck from said second width to said first width to securely hold said backing ring and said retaining ring together.

7. The assembly of claim 5, wherein said channel has outer edges which are outwardly tapered at an angle so as to form respective beveled edges, and wherein said raised neck is wider than said beveled edges such that said raised neck can be securedly held within said channel when said backing ring and said retaining ring are mated.

8. The assembly of claim 7, wherein said angle of taper is of the order of between 1° and 5°.

9. The assembly of claim 7, wherein a width differential between said raised neck and said channel is of the order of 0.002 meters.

10. An annular ring assembly for a chemical mechanical polishing apparatus, comprising:

an annular retaining ring that is releasably connectable to an annular backing ring such that the annular backing ring is reusable with another annular retaining ring, wherein the annular backing ring has a circumferentially extending channel, and the annular retaining ring has a raised circumferentially extending neck, the raised neck being dimensioned to be insertably connected within the channel to releasably secure the backing ring and the retaining ring in a mated relationship; and a plurality of locking pin holes arranged circumferentially around the backing ring and the retaining ring, such that respective ones of the plurality of locking pin holes in the backing ring and in the retaining ring are aligned when the backing ring and the retaining ring are in the mated relationship.

11. The assembly of claim 10, further comprising a plurality of locking pins inserted into said plurality of locking pin holes to prevent relative translational motion of said backing ring and said retaining ring when said rings are in a mated relationship.

12. The assembly of claim 11, wherein said plurality of locking pins are radially extending from an outer surface of said backing ring and said retaining ring.

13. The assembly of claim 11, wherein said plurality of locking pins are perpendicular to a like planar surface of said backing ring and said retaining ring.

14. An annular ring assembly for a chemical mechanical polishing apparatus, comprising:

an annular retaining ring that is releasably connectable to an annular backing ring such that the annular backing ring is reusable with another annular retaining ring, wherein the annular backing ring has a circumferentially extending channel, and the annular retaining ring has a raised circumferentially extending neck, the raised neck being dimensioned to be insertably connected within the channel to releasably secure the backing ring and the retaining ring in a mated relationship, wherein an outer surface of the retaining ring is flat and has a plurality of angular slurry channels disposed thereon.

15. An annular ring assembly for a chemical mechanical polishing apparatus, comprising:

an annular retaining ring that is releasably connectable to an annular backing ring such that the annular backing ring is reusable with another annular retaining ring, wherein the annular backing ring has a circumferentially extending channel, and the annular retaining ring has a raised circumferentially extending neck, the raised neck being dimensioned to be insertably connected within the channel to releasably secure the backing ring and the retaining ring in a mated relationship, wherein an interfacing surface of the backing ring and the retaining ring operates as a parallel reference.

16. An annular ring assembly for a chemical mechanical polishing apparatus, comprising:

an annular retaining ring that is releasably connectable to an annular backing ring such that the annular backing ring is reusable with another annular retaining ring, wherein the annular backing ring has a circumferentially extending channel and a flanged edge, and wherein the retaining ring has a raised circumferentially extending neck, the raised neck being dimensioned with respect to the channel such that the raised neck and the flanged edge of the backing ring cooperate to secure the backing ring and the retaining ring in a mated relationship.

17. The assembly of claim 16, wherein said raised neck and said flanged edge are threaded together.

* * * * *